US005794427A

United States Patent [19]

Cavedon et al.

[11] Patent Number: 5,794,427

[45] Date of Patent: Aug. 18, 1998

[54] PROCESS OF AND APPARATUS FOR MAKING LOW SHRINKAGE YARN

[75] Inventors: Franco Cavedon, Treviso, Italy; Hartmut Ritter, Algolsheim, France; Martin Lohe, Breisach, Germany

[73] Assignee: Madeira Garnfabrik Rudolf Schmidt KG, Freiburg, Germany

[21] Appl. No.: 887,740

[22] Filed: Jul. 3, 1997

[30] Foreign Application Priority Data

Jul. 4, 1996 [DE] Germany ..... 196 27 010.3

[51] Int. Cl.[6] ..... D01H 13/26

[52] U.S. Cl. ..... 57/290; 28/247; 28/271; 57/289; 57/292; 57/309; 57/351; 57/903

[58] Field of Search ..... 57/287, 289, 290, 57/3, 12, 288, 315, 351, 903, 292, 309; 28/247, 271

[56] References Cited

U.S. PATENT DOCUMENTS 4,578,940 4/1986 Negishi et al. ..... 57/903

5,259,098 11/1993 Gupta ..... 28/247

5,359,759 11/1994 Jacob et al. ..... 28/271

5,471,828 12/1995 King ..... 57/351

5,551,225 9/1996 Maruki et al. ..... 57/351

*Primary Examiner*—William Stryjewski

*Attorney, Agent, or Firm*—Henry M. Feiereisen

[57] ABSTRACT

A process of making a low-shrinkage, air-textured yarn, in particular sewing yarn, of synthetic, pre-oriented polymer multifilaments, includes the steps of drawing multifilaments in the form of a single strand at a temperature of about 180° to 230° C. by a factor of 1.6 to 2.5, air-texturing the drawn strand at a rate of overfeed of 1.03 to 1.20 to form a single-strand raw yarn, feeding the raw yarn to a fluffing zone of predetermined length at a rate of overfeed of 1.003 to 1.025, winding the fluffy raw yarn at slightest possible tension, reeling off and twisting the wound raw yarn, and treating the twisted raw yarn at a temperature of 125° to 135° C. over 1 to 3 hours in a dyeing unit, and, optionally, dyeing the raw yarn. The process is equally applicable for making plied yarns.

31 Claims, 3 Drawing Sheets

PROCESS OF AND APPARATUS FOR MAKING LOW SHRINKAGE YARN

BACKGROUND OF THE INVENTION

The present invention refers to a process of and apparatus for making low shrinkage yarn, in particular a sewing yarn, made of synthetic, polymer pre-oriented (POY) multifilaments.

Compared to classical, spun cotton yarns and mixed yarns in which the core yarn is made of polyester and the effect yarn is made of cotton, conventional, synthetic yarns, especially the widely used polyester yarns, can be advantageously made as continuos yarn with hardly any impurities, dyed in a single dyeing process and display a significantly increased strength. Synthetic yarns have however the drawback that they are less fluffy and thus exhibit a more wire-like character and are substantially harder in handle than cotton yarns or mixed yarns. However, clothing manufacturers and in particular linen manufacturers require sewing yarns which for comfort reasons should exhibit a soft and fluffy yarn while allowing easy processing on current industrial sewing machines and yet display a sufficient ultimate tenacity and a smallest possible boiling shrinkage.

Attempts were undertaken to provide a process by which a synthetic yarn can be made with the desired properties. For example, a process is described in the article "Der Lufttexturierprozeß mit integrierten Streck- und Schrumpfzonen", published in magazine 'Chemiefasern/Textilindustrie' 29/81 (1979), p. 857 to 861, in which at least one strand of synthetic polymer pre-oriented multifilaments is highly drawn at temperatures of up to 210° C., air-textured, and the so produced raw yarn is shrunk at temperatures of up to 250° C. at slight thread tension (corresponding to an overfeed of about 1 to 5%), and thus stretch-set. As a consequence of air-texturing and of the filament loops created thereby, an initially fluffy raw yarn is yielded which, however, relinquishes its fluffy, soft character almost completely during shrinkage depending on the set shrinkage condition because the filaments tend to straighten out and the filament loops become smaller or completely vanish. At the high temperature that triggers a shrinkage of the filaments, a crystallization like modification of the molecular structure of the filaments is experienced that may lead, especially in the area of the tightened loops, to the formation of melt droplets. This, too, contributes to a more or less hard and wire-like feel of the finished yarn in handle and promotes yarn ruptures and hook damages as well as a reduced life of the needle. The melt droplets and the otherwise crystallized structure of the yarn moreover complicate a uniform dyeing of the yarn and cause wear during sewing that may impair the operation of the sewing machine.

European Pat. No. EP 0 057 583 B2 describes a similar process for manufacture of an untwisted yarn from at least two multifilament strands for effecting multifilament loops that shrink to "bud-like projections", while a similar process is disclosed in European Pat. No. EP 0 123 479 A2 for making a twisted yarn from at least two multifilament strands, whereby the air-textured raw yarn is twisted, preferably according to the false-twist process before entering the shrinkage zone. While the intended purpose of the additional twisting is to give the yarn a softer feel, the opposite effect was actually experienced because as a result of the even firmer closure of the filaments a more stable yarn is produced in a yarn-technological context.

A further process of making a low shrinkage yarn from at least two multifilament strands is known from German Pat. No. DE 38 34 139 A1. This process results in a sewing yarn having an ultimate tenacity of above 40 cN/tex. Actually, this process yields even yarns with an ultimate tenacity between about 48 and 57 cN/tex by using high strength, low shrink and low stretch multifilaments for the core strand as well as for the effect or fancy strand by maintaining particular titer conditions between the core filaments and the fancy filaments as well as by maintaining particular process conditions especially in the drawing zone prior to the texturing operation. Preferably, after emerging from texturing, the yarn is set by passing it through hot air, while keeping constant the length of the yarn, i.e. is subject to a stretch-setting. This conventional process yields only yarns with a hard, wirelike feel as evidenced by the indicated, high ultimate tenacities. A high ultimate tenacity is however of less relevance even in connection with a sewing yarn. Much more important for the manufacturing industry, that is the clothing manufacturer, in particular the linen manufacturer, are sewing properties of the yarn as well as a strength that corresponds to the sewing article and a smaller residual shrinkage of the finished seam.

SUMMARY OF THE INVENTION

It is an object of the present invention to provide an improved process and apparatus of making low shrinkage yarn, obviating the afore-stated drawbacks.

In particular, it is an object of the present invention to provide an improved process and improved apparatus of making a low shrinkage yarn, in particular a sewing yarn which exhibits a sufficient ultimate tenacity in an area of about 40 cN/tex while yet displaying a fluffy consistency and thus a soft feel as well as having superior sewing properties.

These objects, and others which will become apparent hereinafter, are attained in accordance with the present invention by drawing multifilaments in the form of a single strand at a temperature of about 180° to 230° C. by a factor 1.6 to 2.5; air-texturing the drawn strand at a rate of overfeed of 1.03 to 1.20 to form a single-strand raw yarn; feeding the raw yarn to a fluffing zone of predetermined length at a rate of overfeed of 1.003 to 1.025; winding the fluffy raw yarn at slightest possible tension; reeling off and twisting the wound raw yarn; and treating the twisted raw yarn at a temperature of 125° to 135° C. over 1 to 3 hours in a dyeing unit, and, optionally, dyeing the raw yarn.

This process results in a single-strand, twisted yarn which is soft in handle, has an ultimate tenacity of more than 40 cN/tex and a residual shrinkage of less than about 1% when subject to hot air at a temperature of about 180° C., and displays especially good sewing properties.

Unlike conventional processes, the process according to the invention does not subject the raw yarn after air-texturing to a shrinkage zone but rather to a fluffing zone at a rate of overfeed which is so selected that the raw yarn springs open to a certain degree in correspondence to the elastic tension in the filaments as a result of a swirling caused by air-texturing, and thus becomes fluffy. In order to accomplish this fluffiness, the raw yarn is wound at slightest possible tension, subsequently reeled off at lowest possible tension and twisted in fluffed form. The fluffy and twisted raw yarn is then treated in a conventional dyeing apparatus, even when the finished yarn is supposed to retain its natural color. The treatment in the dyeing apparatus results in a length shrinkage of the raw yarn by about 4–8%. As a consequence, the raw yarn is further fluffed up, and the stability and ultimate tenacity is enhanced while yet retaining its textile feel. Surprisingly, the process according to the invention accomplishes for the first time the manufacture of an air-textured synthetic sewing yarn suitable for use in industrial sewing machines while being made from a single multifilament strand in a particular cost-efficient manner. To date, conventional thinking taught that an air-textured synthetic raw yarn must be based on plied strands, that is a core strand for effecting the required tenacity, and a fancy strand for accomplishing a suitable softness.

Preferably, the drawing step is carried out at a temperature of 205° to 215° C. and at a factor of 2.20 to 2.30.

It is a further object of the present invention to provide an improved process and improved apparatus of making an at least two-component low-shrinkage yarn made of synthetic polymer, pre-oriented (POY) multifilaments, one of which being formed by a core strand and another one of which being formed by a fancy strand.

This object is attained in accordance with the present invention by drawing the core strand by a factor of 1.6 to 2.5 and the fancy strand by a factor of 1.3 to 2.1; feeding the core strand at a rate of overfeed of 1.01 to 1.03 and the fancy strand at a rate of overfeed of 1.10 to 1.35 to an air-texturing unit; feeding the thus-produced plied raw yarn to a fluffing zone of a predetermined length at a rate of overfeed by a factor of 1.003 to 1.025; winding the fluffy raw yarn at slightest possible tension; reeling off and twisting the wound raw yarn; and treating the twisted raw yarn at a temperature of 125° to 135° C. over 1 to 3 hours in a dyeing unit, and, optionally, dyeing the raw yarn.

The process according to the present invention for making plied yarns improves the conventional process disclosed in German Pat. No. DE 38 34 139 A1 that describes a process in which a core strand and a fancy strand are stretched at a different degree and air-textured at different rate of overfeed. In accordance with the present invention, the drawing process as well as the rate of overfeed should be selected in the ranges as set forth, however, it is important to subject the raw yarn after air-texturing to a fluffing zone at a small rate of overfeed depending on the inherent elasticity of the raw yarn and then to further treat the yarn in analogous manner as described with respect to the manufacture of a single strand yarn.

This process according to the present invention yields a yarn which conveys a look that, in effect, cannot be distinguished by the naked eye from conventionally spun yarns.

Preferably, the single yarn and the plied sewing yarns according to the present invention can be produced from polyester filaments. Other synthetic polymers may also be used and are described in the afore-mentioned German Pat. No. DE 38 34 139 A1.

Unlike conventional processes that typically utilize T-shaped air-texturing nozzles for making single yarns, another feature of the present invention includes carrying out the air-texturing step in a Y-shaped air-texturing nozzle.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1A:
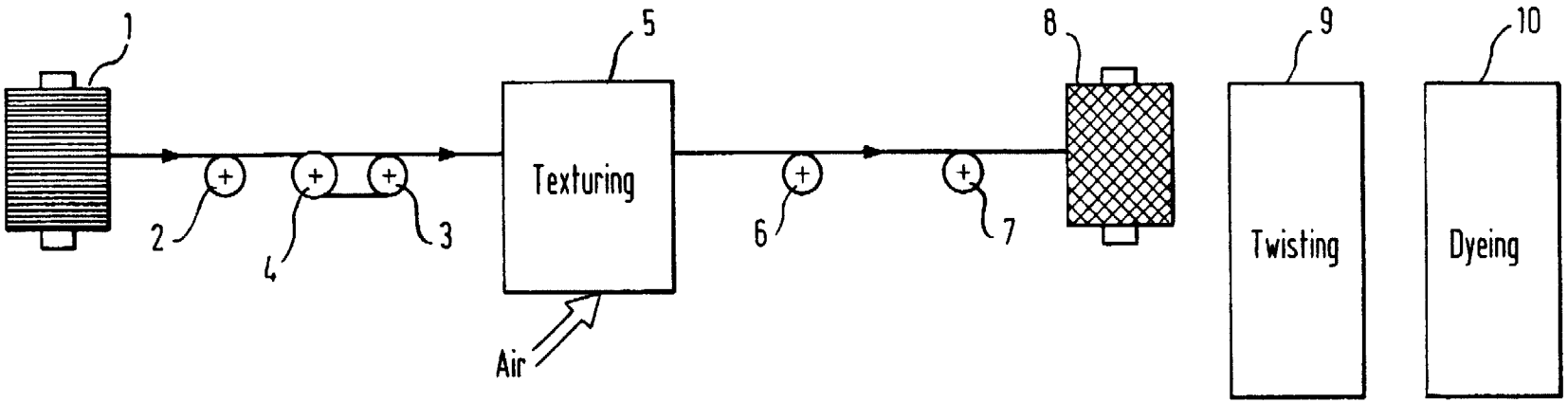
FIG. 1*a* is a schematic representation of an arrangement for carrying out the process of making a single-strand yarn.

Throughout all the Figures, the same or corresponding elements are generally indicated by the same reference numerals.

Figure 1B:
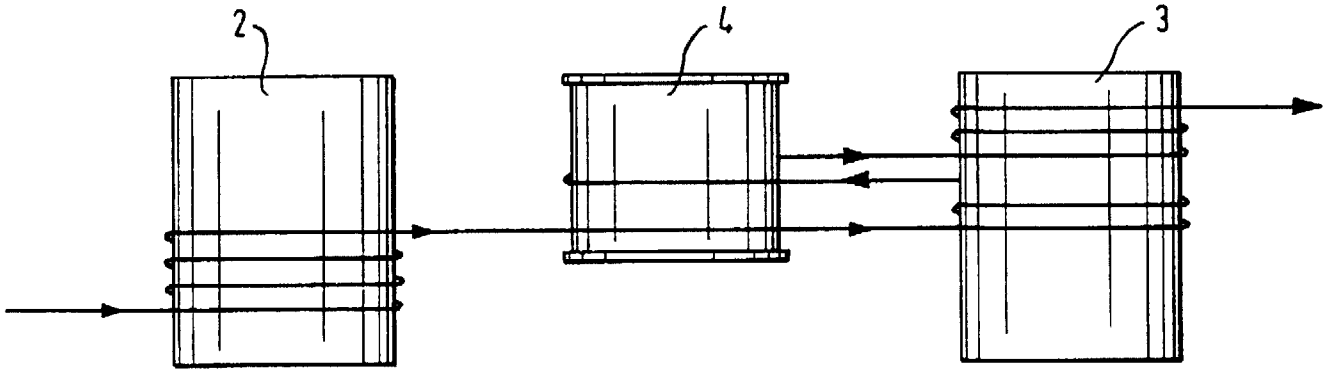
FIG. 1*b* is a schematic illustration of successively arranged rolls of the arrangement of FIG. 1*a*, showing winding of the yarn over the respective rolls.
Figure 4:
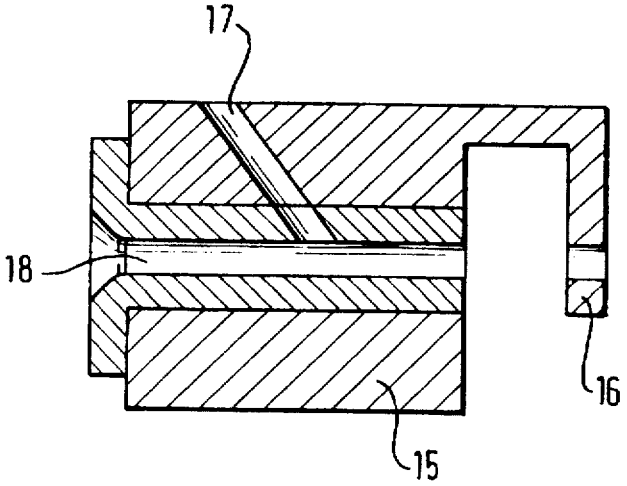
FIG. 4 is a simplified, schematic sectional view of a Y-shaped air-texturing nozzle.

Turning now to the drawing, and in particular to FIG. 1*a*, there is shown a schematic representation of an arrangement for carrying out the process of making a single strand yarn, including a package creel 1 which is equipped with a strand of synthetic multifilament of pre-oriented and partially stretched polyester (POY). The strand is advanced to a drawing zone comprised of an inlet roll 2, an outlet roll 3 and an interposed heated godet or a heated pin 4, with the feed strand passing first the inlet roll 2, then the godet roll 4 and finally the outlet roll 3. Typically, the strand is wrapped in the drawing zone twice at least around the drawing rolls 2, 3, as shown in FIG. 1*b*. In the drawing zone, the strand is stretched at a temperature which may reach approximately 180°–230° C. by a factor of about 1.6 to about 2.5. The drawn strand is subsequently fed to a Y-shaped air texturing nozzle 5 at an overfeed of about 1.03 to about 1.20. An exemplified air-texturing nozzle is made commercially available by the company Heberlein, Switzerland, and is shown schematically in FIG. 4. The Y-shaped air-texturing nozzle 5 includes a housing 15 provided with an outwardly projecting inlet guide 16 of inverted L-shape and having formed therein an air passageway 17 extending slanted with respect to a central passageway 18.

After emerging from the air-texturing nozzle 5, the raw yarn passes through a fluffing zone extending between two rollers 6 and 7 and having a length of approximately 1 m. The roller 6 overfeeds, in respect to the speed of the roller 7, the raw yarn by a factor in the range of about 1.005 to about 1.025. The accurate value of this overfeed is so selected that the raw yarn fluffs up in radial direction in correspondence to the inherent elasticity of its filaments, without sagging inadmissibly between the rollers 6 and 7. The fluffed raw yarn exiting the roller 7 is then wound at lowest possible tension onto a bobbin, for example a cross-wound bobbin 8. The bobbin 8 is subsequently placed in a conventional twisting machine 9 in which the raw yarn, again at lowest possible tension, is reeled off and twisted, (that is by a single turn because only a single strand is concerned here) in correspondence to an alpha metric value between approximately 65 and approximately 85, wherein:

$$\text{alpha metric number of turn per meter divided by } \sqrt{10000/dtex}$$

Figure 3A:
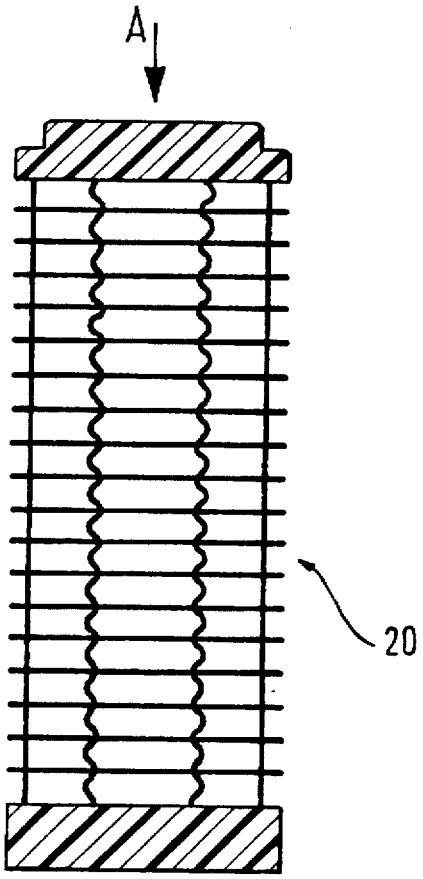
FIG. 3*a* is a plan view of the dye tube taken in direction of arrow A.
Figure 3B:
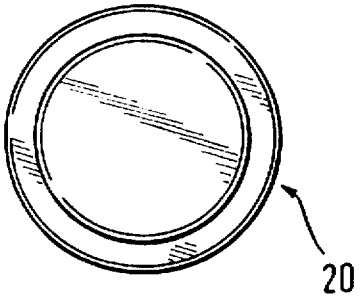
FIG. 3 is a simplified, schematic sectional view of a typical dye tube.

Lower and higher alpha metric values result in deteriorating sewing properties. A higher alpha metric value increases the curling tendency of the yarn. The look of the finished yarn can, optionally, be enhanced by subsequently twisting such turned raw yarns in a conventional manner to form a yarn with respectively higher finished titer, as shown in tables I and II by example 1. The turned and optionally twisted raw yarn then passes through a conventional dyeing unit 10 for treatment in an aqueous liquor typically containing desired dye, for 1 to 3 hours, typically for 2 hours, at a temperature in the range of about 123° to about 135° C. During this treatment, the raw yarn shrinks depending on the starting materials, by about 4 to about 8% to thereby yield the finished yarn. The optionally twisted raw yarn can then be wound onto conventional dye tubes, generally designated by reference numeral 20 and shown by way of example in FIGS. 3*a* and 3*b*, with FIG. 3*a* being a sectional view of the exemplified dye tube 20 and FIG. 3*b* being a plan view of the dye tube 20 in direction of arrow A in FIG. 3*a*.

Figure 2A:
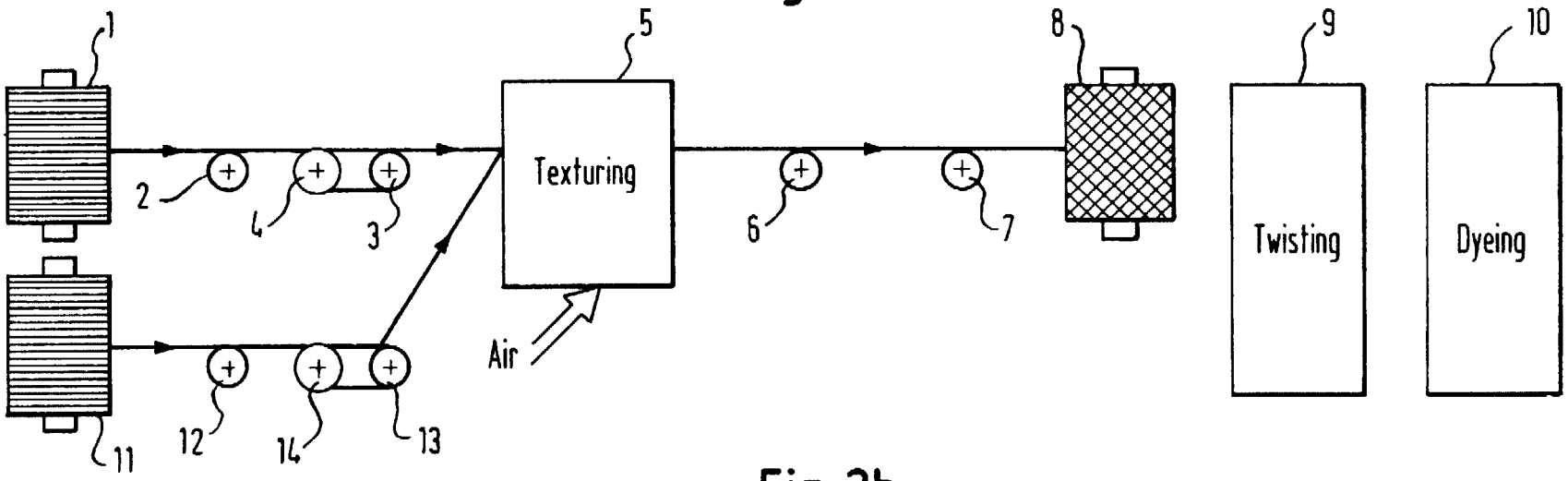
FIG. 2*a* is a schematic representation of an arrangement for carrying out the process of making a two-component yarn.
Figure 2B:
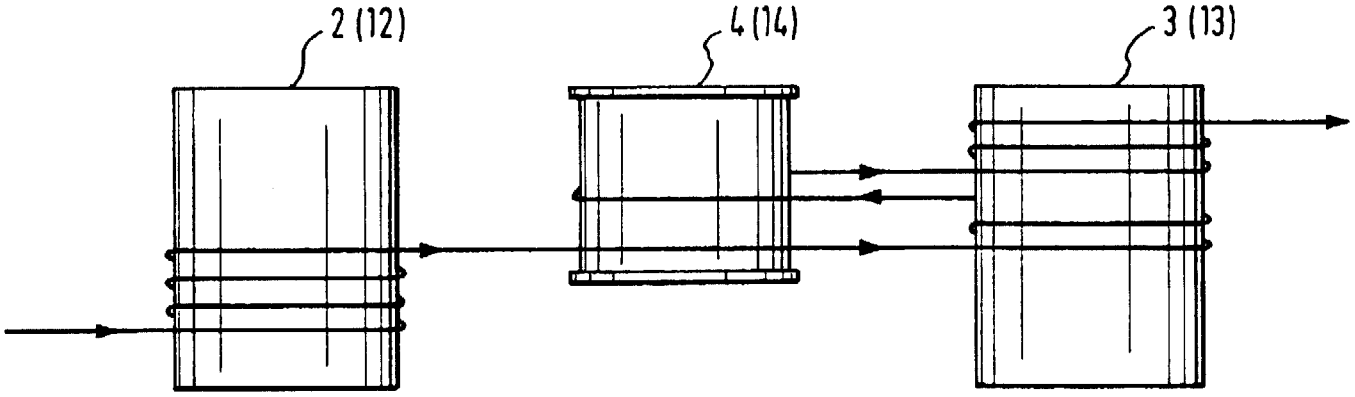
FIG. 2*b* is a schematic illustration of successively arranged rolls of the arrangement of FIG. 2*a*, showing winding of the yarn over the respective rolls.

FIGS. 2*a* and 2*b* are representations for carrying out the process of making a double or two-component yarn, comprised of a core strand and an effect or fancy strand. The package creel 1 is equipped with the core strand which passes through the same process steps as the single multifilament strand according to FIG. 1*a* until reaching the Y-shaped air-texturing nozzle. A second package creel 11 provides the fancy strand which in a same manner as the core strand is advanced through a drawing zone comprised of an inlet drawing roll 12, an outlet drawing roll 13 and a heated godet 14 positioned between the rolls 12, 13. Both strands are fed together into the air-texturing nozzle 5, however at different overfeed. The subsequent process steps are the same as described in connection with the single strand yarn production according to FIG. 1*a*, although process parameters are partially different from the process parameters for making the single strand yarn. In particular, the range of possible drawing of the fancy strand is greater and can amount between 1.3 and 2.1. Conversely, the overfeed of the core strand is generally smaller compared to the single strand yarn and ranges typically between about 1.01 and 1.03 while the fancy strand is fed at an overfeed of about 1.10 to about 1.35. The overfeed of the air-textured raw yarn through the roller 7 is however dimensioned in the same manner as in the case of the single strand yarn.

Table I shows the relevant process parameters for making a single strand sewing yarn (Example 1) according to the process of the present invention and shown in FIGS. 1*a*, 1*b* as well as the process parameters for making double sewing yarns (Examples 2, 3, and 4) of different commercial numbers according to FIGS. 2*a*, 2*b*, whereby reference character "s" and "Z" refer to the directions of turn during twisting, i.e. in clockwise direction and counterclockwise direction.

The respective data with regard to the raw yarn and the finished yarn are illustrated in table II The single-strand sewing yarn according to Example 1 can be made into a finished yarn of the widely used commercial number 120 by twisting two such strands of sewing yarn. Therefor, the final titer is indicated in the table II with 134×2 dtex.

The raw titer values TR rounded up and indicated in table II are calculated from the values indicated in table I, as follows:

EXAMPLE 1

$$TR = \frac{P \times O \times OB}{D \times DA};$$

wherein

TR is the total titer;

P is the starting titer;

O is the overfeed;

OB overfeed during fluffing;

D is the draw for single-strand yarn before texturing;

DA is the draw (in %) during winding, i.e. after fluffing and prior to twisting.

EXAMPLES 2 TO 4

$$TR = \frac{(TC + TE) \times OCE}{DCE};$$

$$\text{with } TC = \frac{PC}{DC} \times OC$$

$$TE = \frac{PE}{DE} \times OE$$

wherein

TR is the total titer;

TC is the titer of the core yarn;

TE is the titer of the effect yarn;

PC is the starting titer of the core yarn;

PE is the starting titer of the effect yarn;

OC is the overfeed of the core yarn;

OE is the overfeed of the effect yarn:

OCE is the overfeed of the core-effect yarn;

DC is the draw of the core yarn;

DE is the draw of the effect yarn;

DCE is the draw of the core-effect yarn.

The finished titer values can be calculated from the raw titer values, multiplied by the shrinkage factor 1.09, indicated in table II.

While the invention has been illustrated and described as embodied in a process of and apparatus for making a low-shrinkage yarn, it is not intended to be limited to the details shown since various modifications and structural changes may be made without departing in any way from the spirit of the present invention.

What is claimed as new and desired to be protected by Letters Patent is set forth in the appended claims.

What is claimed is:

1. A process of making low-shrinkage yarn, in particular sewing yarn, of synthetic, pre-oriented polymer multifilaments, comprising the steps of:

drawing multifilaments in the form of a single strand at a temperature of about 180° to 230° C. by a factor of 1.6 to 2.5;

air-texturing the drawn strand at a rate of overfeed of 1.03 to 1.20 to form a single-strand raw yarn;

feeding the raw yarn to a fluffing zone of predetermined length at a rate of overfeed of 1.003 to 1.025;

winding the fluffy raw yarn at slightest possible tension;

reeling off and twisting the wound raw yarn; and treating the twisted raw yarn at a temperature of 125° to 135° C. over 1 to 3 hours in a dyeing unit, and, optionally, dyeing the raw yarn.

2. The process of claim 1 wherein the drawing step is carried out at a temperature of 205° to 215° C.

3. The process of claim 1 wherein the drawing step is carried out at a factor of 2.20 to 2.30.

4. The process of claim 1 wherein the multifilaments are polyester filaments.

5. The process of claim 1 wherein the air-texturing step is executed for yarns having a finished titer between about 700 and about 100 dtex at a speed in the range from 300 to 500 m/min.

6. The process of claim 1 wherein the air-texturing step is executed in a Y-shaped air-texturing nozzle.

7. The process of claim 1 wherein the raw yarn is fed to the fluffing zone at a rate of overfeed of about 1.01.

8. The process of claim 1 wherein the fluffing zone has a length of about 100 cm.

9. The process of claim 1 wherein the fluffing zone is positioned between a inlet roll and an outlet roll.

10. The process of claim 1 wherein the fluffy raw yarn is wound at a tension in accordance with an elongation of the yarn of 2 to 5%.

11. The process of claim 10 wherein the fluffy raw yarn is wound at a tension in accordance with an elongation of the yarn of 4%.

12. The process of claim 1 wherein the wound raw yarn is provided during the reeling-off step with a twist in correspondence with a alpha metric value between approx. 65 and approx. 85.

13. The process of claim 1 wherein the wound raw yarn is twisted during the reeling-off step in a conventional twisting process and wound on dye tubes.

14. The process of claim 1 wherein the twisted raw yarn is treated at a temperature of about 130° C. for about 2 hours in a dyeing unit.

15. A process of making low-shrinkage yarn, in particular sewing yarn, from at least two strands made of synthetic, pre-oriented polymer multifilaments, one of which being formed by a core strand and another one of which being formed by an effect strand, comprising the steps of:

drawing the core strand by a factor of 1.6 to 2.5 and the effect strand by a factor of 1.3 to 2.1, separately from one another at a temperature in the range of about 130° to 230° C.;

air-texturing the core strand at a rate of overfeed of 1.01 to 1.03 and the effect strand at a rate of overfeed of 1.10 to 1.35;

feeding the thus produced at least two-stranded raw yarn to a fluffing zone of a predetermined length at a rate of overfeed by a factor of 1.003 to 1.025;

winding the fluffy raw yarn at slightest possible tension;

reeling off and twisting the wound raw yarn; and treating the twisted raw yarn at a temperature of 125° to 135° C. over 1 to 3 hours in a dyeing unit, and, optionally, dyeing the raw yarn.

16. The process of claim 15 wherein the multifilaments are polyester multi filaments.

17. The process of claim 15 wherein the core strand is drawn by a factor of 2.0 to 2.4.

18. The process of claim 17 wherein the core strand is drawn by a factor of 2.25.

19. The process of claim 15 wherein the effect strand is drawn by a factor of 1.5 to 1.9.

20. The process of claim 15 wherein the air-texturing step is carried for yarns having a final titer between about 700 and about 100 dtex at a speed in the range from 300 to 500 m/min.

21. The process of claim 15 wherein the air-texturing step is executed in a Y-shaped air-texturing nozzle.

22. The process of claim 15 wherein the raw yarn is fed to the fluffing zone at a rate of overfeed of approx. 1.01.

23. The process of claim 15 wherein the fluffing zone has a length of about 100 cm.

24. The process of claim 15 wherein the fluffing zone is positioned between an inlet roll and an outlet roll.

25. The process of claim 15 wherein the fluffy raw yarn is wound at a tension in accordance with an elongation of the yarn of 2 to 5%.

26. The process of claim 25 wherein the fluffy raw yarn is wound at a tension in accordance with an elongation of the yarn of 4%.

27. The process of claim 15 wherein the wound raw yarn is provided during the reeling-off step with a twist in correspondence with a alpha metric value between approx. 65 and approx. 85.

28. The process of claim 15 wherein the wound raw yarn is twisted during the reeling-off step in a conventional twisting process and wound on dye tubes.

29. The process of claim 15 wherein the twisted raw yarn is treated at a temperature of about 130° C. for about 2 hours in a dyeing unit.

30. Apparatus for making low-shrinkage yarn, in particular sewing yarn, of synthetic, pre-oriented polymer multifilaments, comprising the steps of:

a supply source for providing a strand of multifilaments in the form of a strand;

a drawing unit for drawing the strand at a temperature of about 180° to 230° C. by a factor of 1.6 to 2.5;

a Y-shaped air-texturing nozzle for air texturing the drawn strand at a rate of overfeed of 1.03 to 1.20 to form a single-strand raw yarn;

a fluffing zone defined by a predetermined length and receiving the raw yarn at a rate of overfeed of 1.003 to 1.025;

a take-up reel onto which the fluffy raw yarn is wound at slightest possible tension;

a dyeing unit for treatment of the raw yarn, reeled from the take-up reel, at a temperature of 125° to 135° C. over 1 to 3 hours.

31. Apparatus for making low-shrinkage yarn, in particular sewing yarn, from at least two strands made of synthetic, pre-oriented polymer multifilaments, one of which being formed by a core strand and another one of which being formed by an effect strand, comprising the steps of:

a drawing unit for drawing the core strand by a factor of 1.6 to 2.5 and the effect strand by a factor of 1.3 to 2.1, separately from one another at a temperature in the range of about 130° to 230° C.;

an Y-shaped air-texturing nozzle for air-texturing the core strand at a rate of overfeed of 1.01 to 1.03 and the effect strand at a rate of overfeed of 1.10 to 1.35;

a fluffing zone defined by a predetermined length and receiving the at least two-stranded raw yarn at a rate of overfeed by a factor of 1.003 to 1.025;

a take-up reel onto which the fluffy raw yarn is wound at slightest possible tension;

a dyeing unit for treatment of the raw yarn, reeled from the take-up reel, at a temperature of 125° to 135° C. over 1 to 3 hours.

* * * * *